US005699765A

United States Patent [19]

Duvinage et al.

[11] Patent Number: 5,699,765

[45] Date of Patent: Dec. 23, 1997

[54] CYLINDER HEAD FOR A UNIFLOW-SCAVENGED TWO-STROKE INTERNAL-COMBUSTION ENGINE

[75] Inventors: Frank Duvinage, Kirchheim; Markus Paule, Korb; Michael Krämer, Notzingen; Nils Rippert, Waiblingen; Christian Enderle, Baltmannsweiler, all of Germany

[73] Assignee: Daimler-Benz AG, Germany

[21] Appl. No.: 771,920

[22] Filed: Dec. 23, 1996

[30] Foreign Application Priority Data

Dec. 22, 1995 [DE] Germany ..... 195 48 342.1

[51] Int. Cl.[6] ..... F02B 25/04

[52] U.S. Cl. ..... 123/315; 123/65 VC

[58] Field of Search ..... 123/315, 65 VC, 123/65 V

[56] References Cited

U.S. PATENT DOCUMENTS

| | | | |
|---|---|---|---|
| 3,405,696 | 10/1968 | Zaruba . | |
| 3,865,087 | 2/1975 | Sihon | 123/65 VC |
| 3,918,420 | 11/1975 | Villella | 123/315 |
| 5,000,133 | 3/1991 | Kawamura | 123/65 VC |
| 5,163,395 | 11/1992 | Ishii | 123/257 |
| 5,347,964 | 9/1994 | Reguiero | 123/315 |

FOREIGN PATENT DOCUMENTS

| | | | |
|---|---|---|---|
| 1051970 | 1/1954 | France | 123/315 |
| 24 20 051 B2 | 1/1975 | Germany . | |
| 31 46 875 A1 | 8/1982 | Germany . | |
| 82 23 945.2 | 11/1982 | Germany . | |
| 36 24 107 A1 | 1/1988 | Germany . | |

OTHER PUBLICATIONS

Valve Mechanisms for High-Speed Engines: Their Design and Developments, Philip H. Smith, Second Edition, pp. 68–70; Jan. 1, 1995.

*Primary Examiner*—David A. Okonsky

*Attorney, Agent, or Firm*—Evenson, McKeown, Edwards & Lenahan, P.L.L.C.

[57] ABSTRACT

A cylinder head for a uniflow-scavenged two-stroke internal-combustion engine, particularly in motor vehicles, is provided with outlet valves which can be controlled by a camshaft. Outlet ducts connected with the outlet valves extend out of the cylinder head. A total of four outlet valves are provided for each cylinder, with the associated outlet ducts being guided to one side of the cylinder head. The camshaft is arranged laterally of the cylinder head opposite the outlet side of the outlet ducts. The outlet valves which are situated on the side facing away from the camshaft can be operated from the direction of the camshaft by way of operating members transversely penetrating the cylinder head.

10 Claims, 2 Drawing Sheets

CYLINDER HEAD FOR A UNIFLOW-SCAVENGED TWO-STROKE INTERNAL-COMBUSTION ENGINE

BACKGROUND AND SUMMARY OF THE INVENTION

The present invention relates to a cylinder head for a uniflow-scavenged two-stroke internal-combustion engine, and more particularly, to a cylinder head having outlet ducts controlled by camshaft outlet valves.

A conventional cylinder head is described, for example, in DE-GM 82 23 945. An outlet valve is provided in the cylinder space which is controlled by a cam which has a lift shoulder and a drop shoulder and is arranged on the camshaft. A disadvantage in the case of uniflow-scavenged two-stroke internal-combustion engines is the relatively large height of the cylinder head.

It is, therefore, an object of the present invention to provide a cylinder head which has a relatively low height and nevertheless has a high efficiency while the constructional expenditures are kept to a minimum.

According to the present invention, this object has been achieved by providing four outlet valves respectively for each cylinder, respective outlet ducts of the outlet valves being guided to a side of the cylinder head, wherein the camshaft is arranged laterally of the cylinder head situated opposite the outlet side of the outlet ducts, and certain of the outlet valves situated on the side facing away from the camshaft being operable by the camshaft via operating members transversely penetrating the cylinder head.

By providing four outlet valves for each cylinder in a navel arrangement, a space-saving construction is achieved for the four outlet valves, particularly a clear reduction of the height of the cylinder head in comparison to known cylinder head constructions. Specifically, because of the fact that the outlet ducts assigned to the four outlet valves are guided to one side of the cylinder head, a corresponding space becomes vacant on the other side of the cylinder head which according to the present invention can now be utilized for the positioning of the camshaft.

Instead of the generally customary arrangement of the camshaft in the longitudinal axis of the cylinder head between and above the valves, the camshaft of the present invention is now situated axially parallel to the longitudinal axis of the laterally adjacent cylinder head. In this manner, the cylinder head need only be constructed as high as required for operating the outlet valves.

The outlet valves situated on the side facing away from the camshaft must be operated from the direction of the camshaft by operating members transversely penetrating the cylinder head. For this purpose, various possibilities are within the contemplation of the present invention. In a simple manner, for example, a push rod can be guided along the cylinder head ceiling diagonally through the control space of the cylinder head. For the outlet valves arranged directly laterally next to the camshaft, known rocker arm constructions can be used in a simple manner.

By way of the arrangement of the valves and the pertaining outlet ducts according to the invention, relatively large outlet cross-sections for reducing the scavenging pressure can also be provided according to the present invention. In addition, in this manner, only one hot engine side can be implemented. The cylinder head according to the present invention is nevertheless of a relatively simple construction so as to achieve a substantial cost reduction.

With the cylinder head according to the present invention, an application of a phase adjuster to the camshaft can also be implemented. That is, several relative positions of the camshaft can be adjusted with respect to the crankshaft, whereby changes of the outlet times of the outlet valves become possible.

BRIEF DESCRIPTION OF THE DRAWINGS

These and other objects, features and advantages will become more apparent from the following detailed description of the preferred embodiments when taken in conjunction with the accompanying drawings wherein.

DETAILED DESCRIPTION OF THE DRAWINGS

Figure 1:
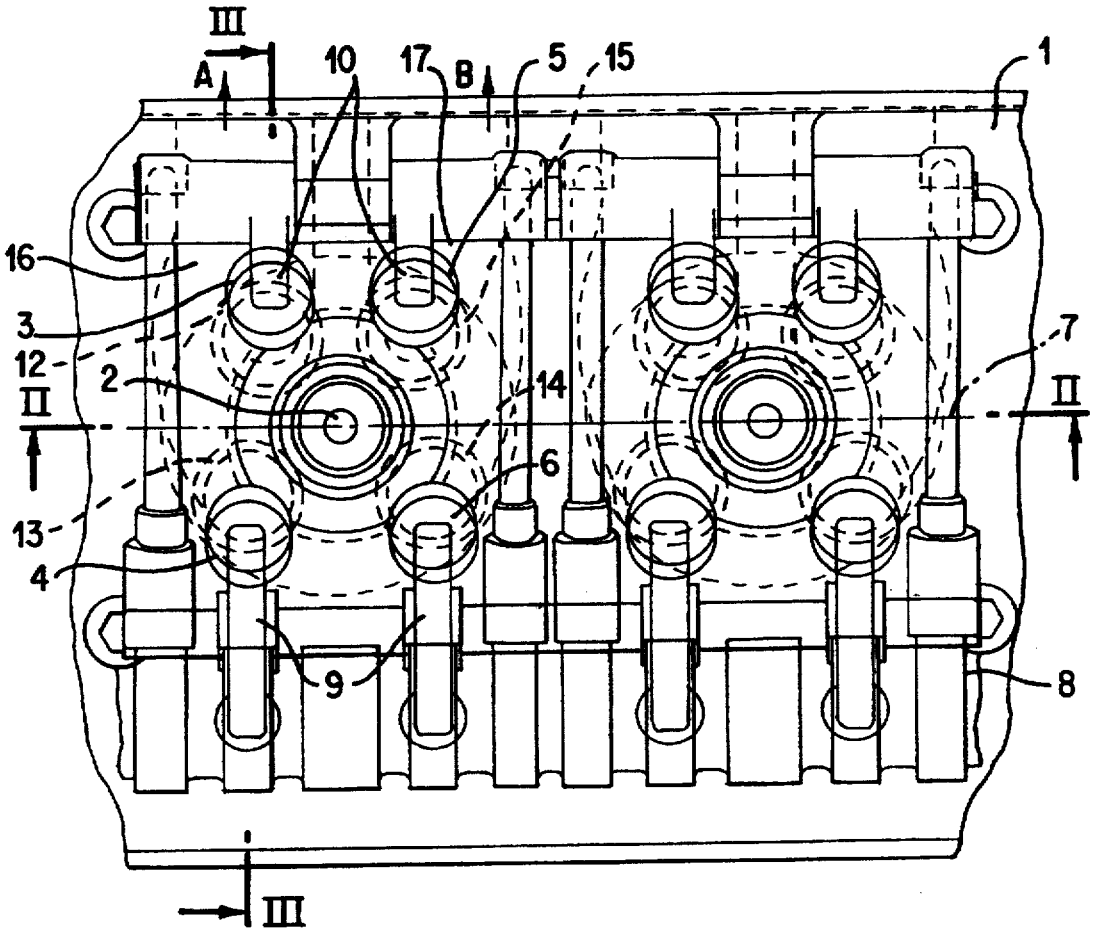
FIG. 1 is a basic diagram of a top view of a cylinder head, without the cover, of a two-cylinder engine for a uniflow-scavenged two-stroke internal-combustion engine according to the present invention.
Figure 2:
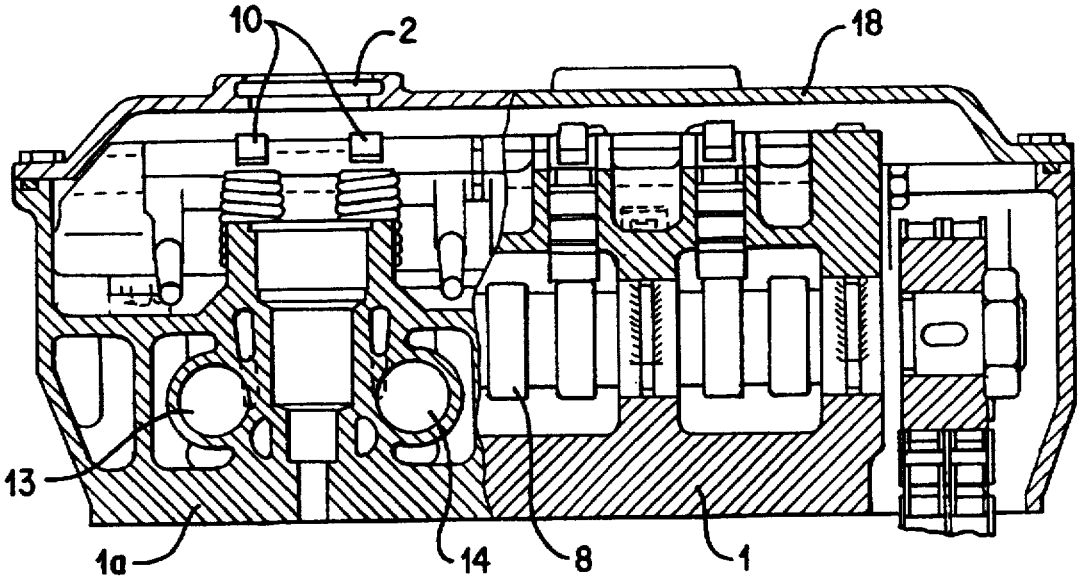
FIG. 2 is a sectional view according to Line II—II of FIG. 1.
Figure 3:
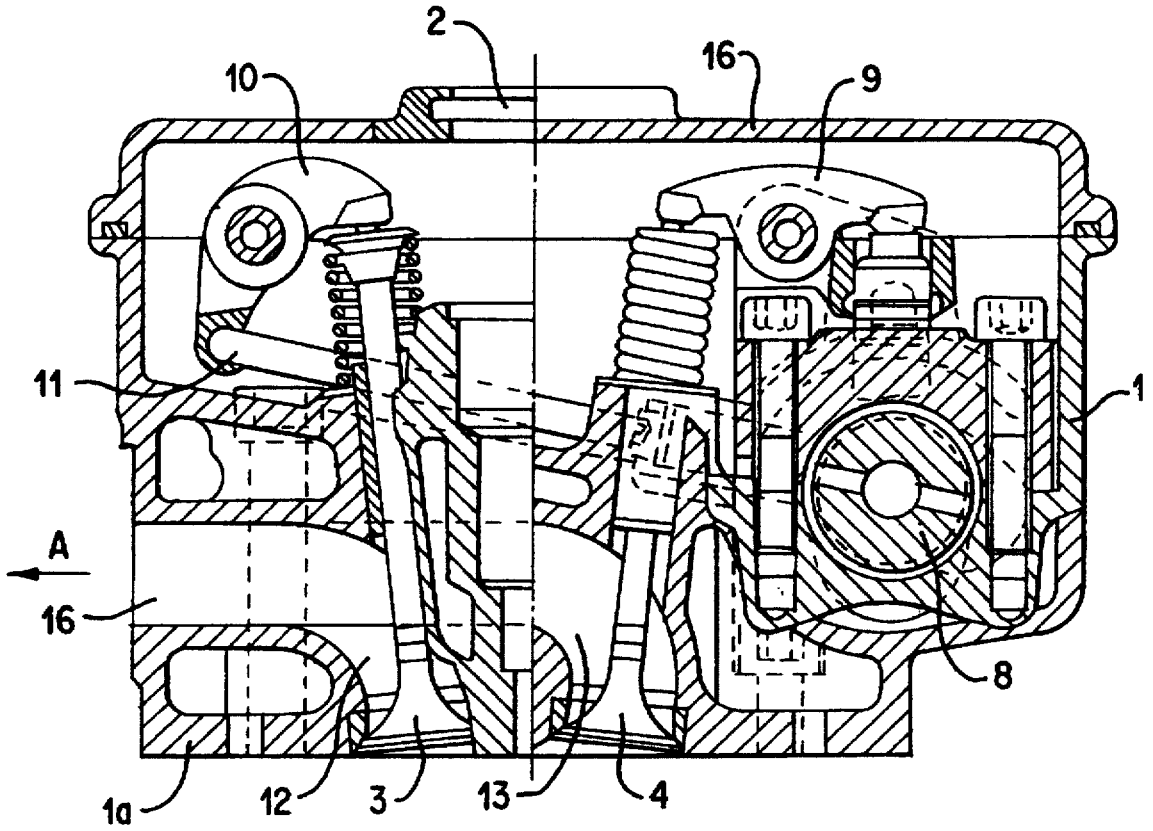
FIG. 3 is a sectional view according to Line III—III of FIG. 1.

A cylinder head 1 covers cylinders (not shown) by a cylinder head bottom 1*a* (FIGS. 2 and 3). For each cylinder, the cylinder head 1 has a centrally arranged shaft 2 for an injection nozzle. For reasons of clarity in FIG. 1, only the parts of the cylinder head 1 for one cylinder are provided with reference numbers.

The cylinder head 1 also comprises four outlet valves 3, 4, 5 and 6 for each cylinder which are arranged in a V-shape with respect to one another and symmetrically with respect to a longitudinal axis 7. The outlet valves 3, 5 are therefore situated on one side of the longitudinal axis 7 of the cylinder block, and the outlet valves 4, 6 are situated correspondingly on the other side of the longitudinal axis 7.

On the side of the longitudinal axis 7 with the outlet valves 4, 6, the cylinder head 1 has a slightly wider construction to permit the installation of a camshaft 8 axially parallel to the longitudinal axis 7 of the cylinder head. With respect to the height, the center axis of the camshaft 8 is situated approximately at the half point of the length of the outlet valve shafts. The outlet valves 4, 6 which are situated on the same side of the cylinder head as the camshaft 8 are operated by cams of the camshaft 8 by way of a rocker lever construction 9 with play compensating elements.

The outlet valves 3, 5 situated on the other side are operated by rocker levers 10 having play compensating elements. For the operation of the rocker levers 10, push rods 11 are used which extend through the cylinder head 1 transversely and sloped downward in the direction of the camshaft 8 along the cylinder head ceiling as seen in see FIG. 3. The push rods 11 are operated in the same manner as the rocker levers 9 by cams of the camshaft 8.

The outlet valves 3, 4, 5 and 6 each control one respective outlet duct 12, 13, 14 and 15. The outlet duct 13 for the outlet valve 4, which is situated on the side of the cylinder head 1 in which the camshaft 8 is also disposed, is guided in the direction of the outlet valve 3 situated on the other side, where it is combined with the outlet duct 12 to form a common collecting duct 16. On the side (i.e., outlet side) facing away from the camshaft 8, the collecting duct 16 is guided laterally out of the cylinder head in the direction of arrow A as seen in FIGS. 1 and 3.

Likewise, the outlet duct 14 of the outlet valve 6 is guided to the side of the cylinder head facing away from the camshaft 8 and is combined there with the outlet duct 15 of the outlet valve 5 to form a common collecting duct 17 which corresponding to arrow B in FIG. 1 leads out of the cylinder head on the same side as the collecting duct 16. For reasons of clarity, the individual ducts are illustrated in FIG. 1 only by broken lines. In conjunction with FIGS. 2 and 3, however, their respective position and course are clearly recognizable.

The guiding together of the outlet ducts 13, 14 in pairs to form the two collecting ducts 16, 17 represents another constructive simplification and saving of space. In addition, an intensive water cooling can be achieved, particularly between the outlet ducts. In comparison to known cylinder head constructions, a height reduction of approximately 40% can be achieved. As illustrated, the cylinder head can be closed off in a known manner directly above the rocker levers 9, 10 by a cylinder head cover 18.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A cylinder head for a uniflow-scavenged two-stroke internal-combustion engine, comprising outlet ducts controllable by outlet valves of a camshaft, four outlet valves respectively for each cylinder, respective outlet ducts of the outlet valves being guided to a side of the cylinder head, wherein the camshaft is arranged laterally of the cylinder head situated opposite the outlet side of the outlet ducts, and certain of the outlet valves situated on the side facing away from the camshaft being operable by the camshaft via operating members transversely penetrating the cylinder head.

2. The cylinder head according to claim 1, wherein the outlet ducts are guided together in pairs to form one respective collecting duct.

3. The cylinder head according to claim 2, wherein the respective outlet ducts of the two outlet valves arranged on opposite sides relative to a longitudinal axis are guided together to form a collecting duct.

4. The cylinder head according to claim 1, wherein the operating members are push rods.

5. The cylinder head according to claim 1, wherein the outlet valves arranged on the side of the cylinder head with the camshaft are operable via rocker levers.

6. The cylinder head according to claim 4, wherein the outlet ducts are guided together in pairs to form one respective collecting duct.

7. The cylinder head according to claim 6, wherein the respective outlet ducts of the two outlet valves arranged on opposite sides relative to a longitudinal axis are guided together to form a collecting duct.

8. The cylinder head according to claim 5, wherein the outlet ducts are guided together in pairs to form one respective collecting duct.

9. The cylinder head according to claim 8, wherein the respective outlet ducts of the two outlet valves arranged on opposite sides relative to a longitudinal axis are guided together to form a collecting duct.

10. The cylinder head according to claim 9, wherein the operating members are push rods.

* * * * *